US005526581A

United States Patent [19]

Winterson et al.

[11] Patent Number: 5,526,581

[45] Date of Patent: * Jun. 18, 1996

[54] PROCESS FOR ADJUSTING THE MOISTURE CONTENT OF ORGANIC MATERIALS

[75] Inventors: Warren D. Winterson, Midlothian; John C. Crump, III, Richmond; Eugene B. Fischer, Chester, all of Va.

[73] Assignee: Philip Morris Incorporated, New York, N.Y.

[ * ] Notice: The portion of the term of this patent subsequent to Jan. 24, 2012, has been disclaimed.

[21] Appl. No.: 969,109

[22] Filed: Oct. 30, 1992

[51] Int. Cl.[6] ..... F26B 3/00

[52] U.S. Cl. ..... 34/474; 34/491

[58] Field of Search ..... 34/467, 471, 474, 34/475, 477, 72, 74, 491

[56] References Cited

U.S. PATENT DOCUMENTS

| | | | |
|---|---|---|---|
| 2,105,848 | 1/1938 | Touton | 34/24 |
| 3,799,176 | 3/1974 | Wochnowski | 131/135 |
| 3,879,857 | 4/1975 | Neville | 34/10 |
| 3,938,651 | 2/1976 | Alfred et al. | 198/136 |
| 4,004,594 | 1/1977 | Wochnowski et al. | 131/135 |
| 4,089,666 | 5/1978 | Knight | 62/91 |
| 4,178,946 | 12/1979 | Knight | 131/135 |
| 4,202,357 | 5/1980 | de la Burde et al. | 131/140 R |
| 4,241,515 | 12/1980 | Wochnowski . | |
| 4,565,282 | 1/1986 | Olsson et al. | 198/778 |
| 4,583,559 | 4/1986 | Hedge | 131/304 |
| 4,603,776 | 8/1986 | Olsson | 198/778 |
| 4,899,871 | 2/1990 | Olsson | 198/778 |
| 4,941,567 | 7/1990 | Olsson | 198/778 |
| 5,050,313 | 9/1991 | Wakaeya et al. | 34/50 |

FOREIGN PATENT DOCUMENTS

| | | | |
|---|---|---|---|
| 964151 | 3/1975 | Canada | 131/90 |
| 1257444 | 12/1971 | United Kingdom . | |

*Primary Examiner*—Henry A. Bennett

*Attorney, Agent, or Firm*—Charles E. B. Glenn; James E. Schardt; Kevin B. Osborne

[57] ABSTRACT

A process for reordering tobacco or other suitable hygroscopic organic material, which results in no significant decrease in the equilibrium CV of the tobacco or other hygroscopic organic material, or significant degradation of the tobacco or other hygroscopic organic material, is provided. Material to be reordered is contacted with an air stream having a relative humidity near the equilibrium conditions of the material. As the OV content of the hygroscopic organic material increases, the relative humidity of the air stream contacting the hygroscopic organic material is increased to affect reordering of the material. Also provided is a process for drying tobacco or other suitable hygroscopic organic material, which results in no significant change in the equilibrium CV of the tobacco or other hygroscopic organic material or significant degradation of the tobacco or other suitable hygroscopic organic material. Material to be dried is contacted with an air stream having a relative humidity near or below the equilibrium conditions of the material. As the OV content of the hygroscopic organic material decreases, the relative humidity of the air stream contacting the hygroscopic organic material is decreased to affect drying of the material.

It has been found that tobacco can be reordered or dried successfully according to the processes of the present invention in a continuous manner using a self-stacking spiral conveyor.

53 Claims, 7 Drawing Sheets

PROCESS FOR ADJUSTING THE MOISTURE CONTENT OF ORGANIC MATERIALS

BACKGROUND OF THE INVENTION

This invention relates to processes for reordering, i.e., increasing the moisture content, and drying tobacco or other hygroscopic organic materials, such as pharmaceutical and agricultural products, including but not limited to fruits, vegetables, cereals, coffee, and tea. More particularly, this invention relates to the use of controlled humidity air to moisten or dry these materials.

The art has long recognized the desirability of controlling the moisture content of various organic materials, including tobacco. For example, the moisture content of tobacco that has been processed into a useful product has been altered numerous times. Each processing step, e.g., stem removal, cutting, blending components, adding flavors, expansion and fabricating into cigarettes, requires certain optimum moisture levels, which must be controlled carefully, to ensure top quality tobacco and other hygroscopic organic material products. Moreover, the manner in which the moisture content of the tobacco is altered can have a lasting effect on the physical, chemical and subjective characteristics of the final product. Accordingly, the methods used for bringing about changes in the moisture content of tobacco or other organic materials are important.

Reordering of expanded tobacco is a particularly demanding process. Typically, tobacco obtained from the expansion process will have a moisture content below 6%, and often less than 3%. At such low moisture contents the tobacco is very susceptible to breakage. Additionally, the expanded tobacco structure is subject to collapse upon reordering, i.e., a full or partial return of the tobacco to its unexpanded state. This collapse results in a loss of filling power, thus decreasing the benefit derived from the expansion process.

Various means for reordering expanded tobacco have been used. The most common method is to subject the tobacco to a water spray, typically while tumbling the tobacco in a rotating cylinder. Another method is to use saturated steam as the reordering medium. Yet another method is to blow high humidity air through a moving bed of tobacco on a conveyor, as shown in U.S. Pat. No. 4,178,946.

None of the above methods has been found to be completely satisfactory for use on expanded tobacco. Tumbling tobacco in a spray cylinder results in breakage of the fragile expanded tobacco. Direct contact with liquid water tends to cause collapse of the expanded tobacco structure. Steam reordering also results in expanded tobacco structure collapse. While this may be partially attributed to the high temperatures in a steam environment, exposing expanded tobacco to any gaseous environment in which water condensation occurs, such as a steam or highly humidified air environment, results in collapse.

One method, which has been employed to avoid these difficulties, is to place dry, expanded tobacco in a chamber containing air at a desired humidity level and allow the tobacco to equilibrate in the chamber over a period of from 24 hours to 48 hours. Air velocity through the chamber is kept very low, typically not more than about 25 feet per minute. This procedure results in little or no collapse of the expanded tobacco structure. However, the long times required, 24 hours to 48 hours, have limited its application to laboratory purposes.

Attempts have been made to reduce the residence time required of such equilibration processes by increasing air velocity. Such approaches have been unsuccessful due to an inability to duplicate the maintenance of filling power observed in slow laboratory equilibration, the size of conveyors required to carry the tobacco in order to accommodate the long residence times required, the nonuniformity of the moisture content of the tobacco product exiting such conveyors, and the incidence of fires in such units as described in U.S. Pat. No. 4,202,357.

The use of drying as a means for controlling moisture content during the processing of tobacco is of equal importance as that of reordering. When tobacco is dried, both physical and chemical changes can occur that affect the physical and subjective quality of the product. Therefore, the method of drying tobacco is exceedingly important.

There are two types of drying equipment generally used by the tobacco industry: rotary driers and belt or apron driers. Pneumatic-type driers are also used occasionally. The particular dryer used is chosen for the drying operation required. Belt or apron driers, for example, are normally used for strip tobacco, whereas rotary driers are used for cut tobacco. Both rotary and belt driers are used for drying stems.

In a belt dryer, tobacco is spread on a perforated belt and air is directed either upward or downward through the belt and tobacco bed. Nonuniform drying of the tobacco often occurs due to channels being blown in the bed allowing the drying air to locally bypass the tobacco.

Most rotary driers used in the tobacco industry are lined with steam coils and may function as either indirect or direct heat driers depending on whether the heat is applied outside or inside the drier shell containing the tobacco. Moreover, they may be operated either co-currently where the tobacco and air flow in the same direction or countercurrently where the tobacco and air flow in opposite directions. Rotary drying must be controlled carefully to avoid overdrying, which causes both chemical changes and unnecessary breakage by the rotary motion. In addition, if drying occurs too quickly, an impervious layer may be formed on the outer surface of the tobacco making it difficult for moisture on the inside of the tobacco to diffuse to the surface. The formation of such a layer slows the drying rate and results in nonuniformity in drying.

Use of a rotary or belt drier to dry tobacco can result in a thermal treatment that may result in chemical and physical changes to the tobacco. While not always undesirable, these changes are driven by the objective of removing water from the tobacco. In typical tobacco applications, the need to dry the tobacco in a limited amount of time dictates a thermal treatment result from the drying step, preventing optimization of thermal treatment apart from the process constraints imposed by drying.

The present invention provides a means of reordering or drying tobacco or other suitable hygroscopic organic materials, such as pharmaceutical and agricultural products, including but not limited to fruits, vegetables, cereals, coffee, and tea, with little or no breakage, even of the fragile tobacco exiting the expansion process. It further provides a means of reordering expanded tobacco with little or no loss of expanded tobacco structure. It further provides a means of drying tobacco or other suitable hygroscopic organic material, at approximately atmospheric pressure, for example, without the use of vacuum and at a selected temperature wherein the thermal treatment imparted can be controlled during the process to an extent unattainable in conventional tobacco drying processes.

BRIEF SUMMARY OF THE INVENTION

Changes in the moisture content of tobacco or other suitable organic materials are affected by contacting the organic material with air which has a relative humidity carefully controlled above or below the equilibrium relative humidity of the organic material with which it is in contact. The relative humidity of the air is continuously increased or decreased, as appropriate, during processing to maintain a controlled differential between the relative humidity of the air and the equilibrium relative humidity of the organic material with which it is in contact. Careful, continuous control of relative humidity allows control of the rate of moisture mass transfer between the organic material and its environment so that structural changes to the organic material are minimized. Utilization of relative humidity as the primary driving force for moisture mass transfer allows independent control of thermal treatment. This process can be carried out in either a batch or continuous fashion. Furthermore, the process can be carried out without the use of rotating cylinders and the consequent breakage that occurs with their use.

DETAILED DESCRIPTION OF THE INVENTION

Figure 1:
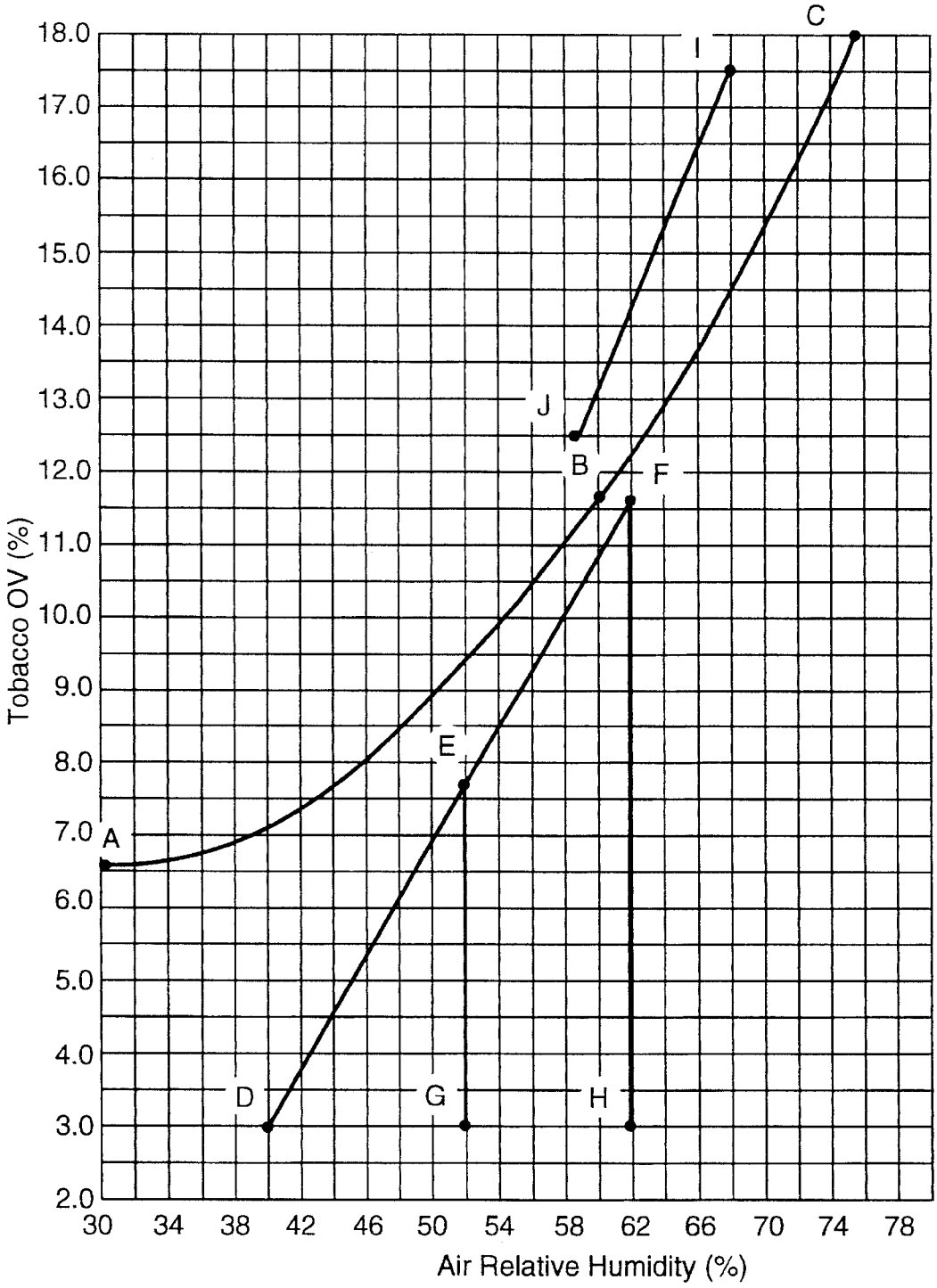
FIG. 1 is a plot of air relative humidity (RH) percent versus tobacco moisture content or OV.

The present invention relates to processes for adjusting the moisture content of tobacco or other suitable hygroscopic organic material, such as pharmaceutical and agricultural products, including but not limited to fruits, vegetables, cereals, coffee, and tea, while minimizing breakage, changes to the physical structure, or thermally driven changes to the chemical composition of the tobacco or hygroscopic organic material to be treated. More particularly, the present invention relates to the use of controlled humidity air for the purpose of either reordering or drying tobacco or other suitable hygroscopic organic material. The moisture content of tobacco or other suitable hygroscopic organic material is either increased or decreased by gradually and continuously increasing or decreasing, as appropriate, the relative humidity of the air contacting the tobacco. In this manner moisture transfer is controlled, allowing other process variables such as temperature, air velocity, and air pressure to be optimized separately.

Two commonly used methods for characterizing the physical structure of tobacco are cylinder volume (CV) and specific volume (SV). These measurements are particularly valuable in assessing the benefits of this process in reordering tobacco.

Cylinder Volume (CV)

Tobacco filler weighing 20 grams, if unexpanded, or 10 grams, if expanded, is placed in a 6-cm diameter Densimeter cylinder, Model No. DD-60, designed by the Heinr. Borgwaldt Company, Heinr. Borgwaldt GmbH, Schnackenburgallee No. 15, Postfack 54 07 02, 2000 Hamburg 54 West Germany. A 2-kg piston, 5.6 cm in diameter, is placed on the tobacco in the cylinder for 30 seconds. The resulting volume of the compressed tobacco is read and divided by the tobacco sample weight to yield the cylinder volume as cc/gram. The test determines the apparent volume of a given weight of tobacco filler. The resulting volume of filler is reported as cylinder volume. This test is carried out at standard environmental conditions of 75° F. and 60% RH; conventionally, unless otherwise stated, the sample is preconditioned in this environment for 24–48 hours.

Specific Volume (SV)

The term "specific volume" is a unit for measuring the volume occupied by solid objects, e.g., tobacco, using Archimedes' principle of fluid displacement. The specific volume of an object is determined by taking the inverse of its true density. Specific volume is expressed in "cc/grams". Both mercury porosity and helium pycnometry are suitable methods for making these measurements, and the results have been found to correlate well. When helium pycnometry is used, a weighed sample of tobacco, either "as is", dried at 100° C. for 3 hours, or equilibrated, is placed in a cell in a Quantachrome Penta-Pycnometer Model 2042-1, (manufactured by Quantachrome Corporation, 5 Aerial Way, Syosset, N.Y.). The cell is then purged and pressured with helium. The volume of helium displaced by the tobacco is compared with volume of helium required to fill an empty sample cell. The tobacco volume is determined based on the fundamental principles of the ideal gas law. As used throughout this application, unless stated to the contrary, specific volume was determined using the same tobacco sample used to determine OV, i.e., tobacco dried after exposure for 3 hours in a circulating air oven controlled at 100° C.

As used herein, moisture content may be considered equivalent to oven-volatiles content (OV) since not more than about 0.9% of tobacco weight is volatiles other than water. Oven-volatiles determination is a simple measurement of tobacco weight loss after exposure for 3 hours in a circulating air oven controlled at 100° C. The weight loss as percentage of initial weight is oven-volatiles content.

"Sieve test" refers to a method of measuring the shred-length distribution of a sample of cut filler. This test is frequently used as an indicator of degradation of shred length during processing. Tobacco filler weighing 150±20 grams, if unexpanded, or 100±10 grams, if expanded, is placed in a shaker apparatus. The shaker apparatus utilizes a series of 12-inch diameter, round screen trays (manufactured by W.S. Tyler, Inc., a subsidiary of Combustion Engineering Inc. Screening Division, Mentor, Ohio 44060) that meet ASTM (American Society of Testing Materials) standards. Normal screen sizes for sieve trays are 6 mesh, 12 mesh, 20 mesh, and 35 mesh. The apparatus has a shaking distance (stroke) of about 1½ inches, and a shaking speed of 350±5 rpm. The shaker agitates the tobacco for a period of 5 minutes in order to separate the sample into different particle size ranges. Each of the particle size ranges is weighed, thus yielding a particle size distribution of the sample.

Laboratory experiments have shown that attempts to reorder tobacco rapidly by exposing the tobacco to high humidity air results in CV losses. It has also been shown that CV losses occur when either condensation or overwetting occur within a bed of expanded tobacco. Condensation occurs when humid air contacts tobacco which is at a temperature below the dew point of the humid air. Overwetting can occur when moisture variations are created within a tobacco bed due to non-uniform exposure to humid air. Therefore, a successful humid-air reordering system must operate at a relatively slow rate with good control of the air relative humidity, air temperature, air flow and pressure through the bed of tobacco. This is best accomplished by gradually increasing the moisture content of the humid air passing through the tobacco in such a manner that the tobacco is exposed to a stream of air which is nearly at equilibrium with the tobacco.

Referring to FIG. 1, line ABC is an isotherm for 75° F. for a typical expanded bright tobacco. This isotherm relates the tobacco's OV to the RH of the air surrounding it at equilibrium for a given temperature. Thus point B indicates that at 75° F. and 60% RH, this sample of expanded tobacco will have an OV of about 11.7% upon equilibration. Line DEF of FIG. 1 represents a typical RH profile for tobacco which is reordered, according to this invention. Line GEF of FIG. 1 represents an alternative RH profile which also has been found satisfactory. Line HF of FIG. 1 represents a path typical of the prior art such as laboratory reordering in an equilibrium chamber at very low air velocities. Line IJ of FIG. 1 represents the application of this invention to the drying of the tobacco.

FIG. 1 shows that reordering tobacco from an OV of about 6.5%, where it would be in equilibrium with air having about 30% RH, to an OV of about 11.7%, where it would be in equilibrium with air having about 60% RH, could be accomplished by exposing it to air which is increased in moisture from about 40% RH in small increments over a period of time until it reaches about 60% RH, rather than being exposed to 60% RH air directly. When carried out under these slowly changing conditions, mass transfer between the air stream and the tobacco is relatively slow because the driving force is small, and the expanded tobacco structure is maintained. Reordering of expanded tobacco with no loss in CV may also be achieved by exposing the tobacco to air which is increased in moisture content from about 40% RH in small increments over a period of time of about 40% RH in small increments over a period of time of about 40 to about 60 minutes until it reaches an RH of about 62%. This reduces the overall time required to complete the reordering process without significantly changing the expanded tobacco structure. Thus, lines DEF and GEF of FIG. 1 each represent effective embodiments of the present invention when reordering tobacco.

Referring to FIG. 1, near-equilibrium conditions between the air stream and the tobacco are illustrated by line segment EF and line ABC. It will be appreciated that at tobacco OV's below about 7% the difference between the relative humidity of the air in equilibrium with the tobacco and the relative humidity of the humid air stream used for reordering can be quite large without adversely affecting the filling power of the tobacco. It will also be appreciated that at tobacco OV's from about 7.5% to about 11.5% the relative humidity of the humid-air stream used for reordering can be from about 2% to about 8% above the relative humidity of the air in equilibrium with the tobacco, with the greater deviation from equilibrium corresponding to the lower tobacco OV, without adversely affecting the filling power of the tobacco.

When the present invention was used to dry tobacco, no measured loss in tobacco CV was observed. This was found to be the case even when the relative humidity of the drying air stream was significantly below the relative humidity of the air in equilibrium with the tobacco, i.e., the relative humidity of the drying air stream was below the equilibrium conditions of the tobacco. Therefore, it will be appreciated that line IJ of FIG. 1 illustrates only one of many possible paths which may be used when drying tobacco according to the present invention.

It will be appreciated by one skilled in the art that isotherms similar to FIG. 1 may be constructed for other suitable hygroscopic organic material, such as pharmaceutical and agricultural products, including but not limited to fruits, vegetables, cereals, coffee, and tea.

Figure 2:
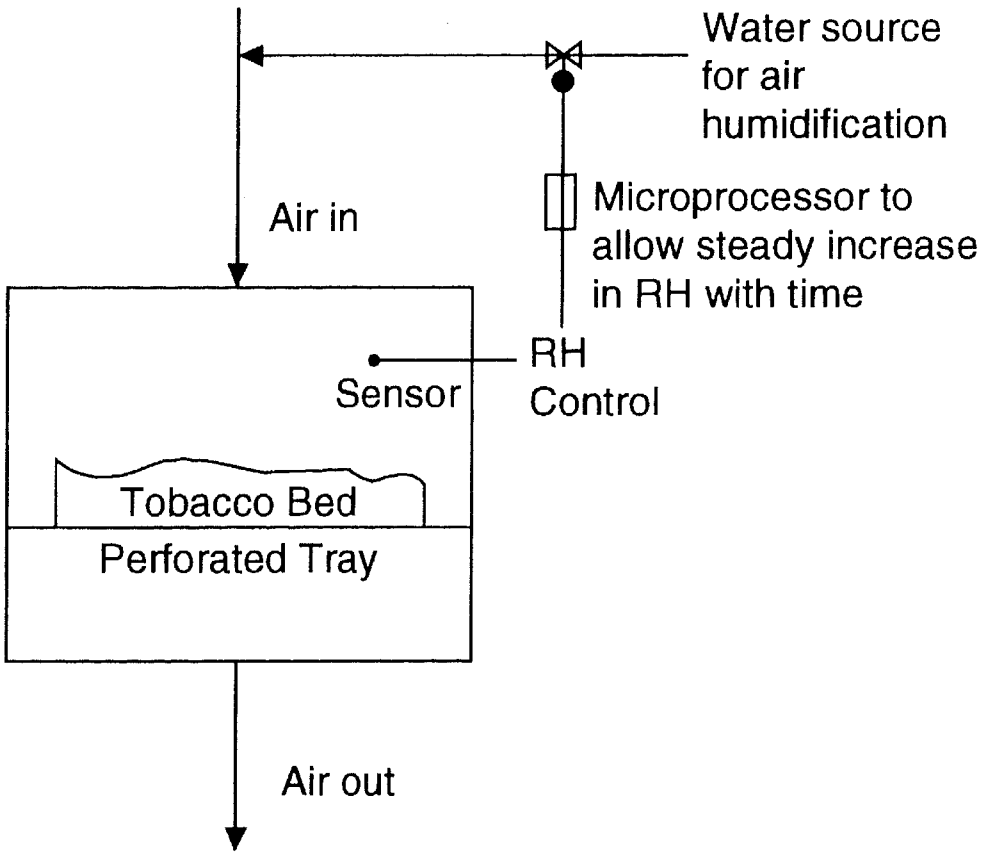
FIG. 2 is a schematic diagram of a laboratory apparatus for reordering hygroscopic organic material according to this invention by ramping air RH over time.

The present invention may be carried out as either a batch or a continuous process. When carried out as a batch reordering process, the relative humidity of the air stream contacting the tobacco or other suitable hygroscopic organic material is increased over time to provide a continuous increase in moisture content of the tobacco or other suitable hygroscopic organic material. This may be accomplished in an environmental chamber such as the one illustrated in FIG. 2. For example, tobacco to be reordered is placed at a bed depth of about 2 inches, in trays having screen mesh bottoms, inside an environmental chamber so that a stream of controlled humidity air may pass through the tobacco in a downward direction. Chambers ranging in size from about 20 cubic feet to about 80 cubic feet (manufactured by Parameter Generation and Control, Inc., 1104 Old US 70, West, Black Mountain, N.C. 28711) were used in a number of studies. The environmental chambers were equipped with microprocessors which permitted controlled ramping of humid-air conditions within the chamber. Tests were conducted in which dry expanded tobacco was reordered from initial OV levels of about 2% to final OV levels of about 11.5% by incrementally ramping the RH from initial levels as low as about 30% RH and as high as about 52% RH over periods ranging from about 30 minutes to about 90 minutes to final RH levels between about 59% and about 65%. Air velocities in the range of about 50 feet/minute to about 200 feet/minute were used. RH and temperature measurements were monitored with a Thunder model 4A-1 instrument (manufactured by Thunder Scientific Corp., 623 Wyoming, S.E., Albuquerque, N.M. 87123). Air velocities were measured with an Alnor Thermo Anemometer model 8525 (manufactured by Alnor Instrument Co., 7555 N. Linder Ave, Skokie, Ill. 60066). Tests in which relative humidities were ramped from starting values as high as about 52% to final RH values as high as about 62% in time as short as about 40 minutes, resulted in a reordered tobacco with full CV retention when compared to similar tobacco reordered in an environmentally controlled room with air maintained at 60% RH and 75° F. passing through the tobacco at low velocity for 24 hours to 48 hours. Ramping in this manner was successful with humid-air velocities as high as about 200 feet/minute and temperatures from about 75° F. to about 90° F. Expanded tobacco reordered in this manner showed minimal, if any, loss of CV compared to expanded tobacco reordered in an environmentally controlled room.

Figure 3:
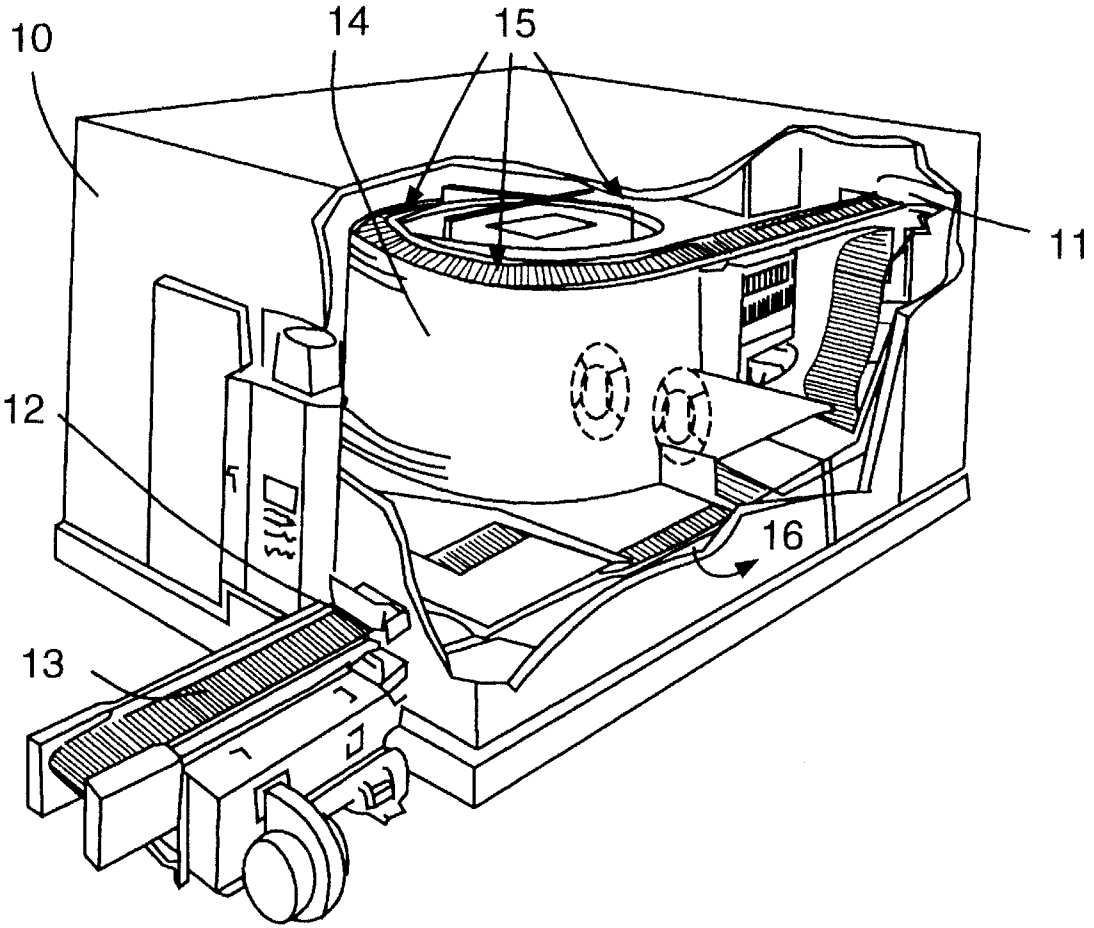
FIG. 3 is a cut-away view of an exemplary apparatus for carrying out this invention on a continuous basis.
Figure 3A:
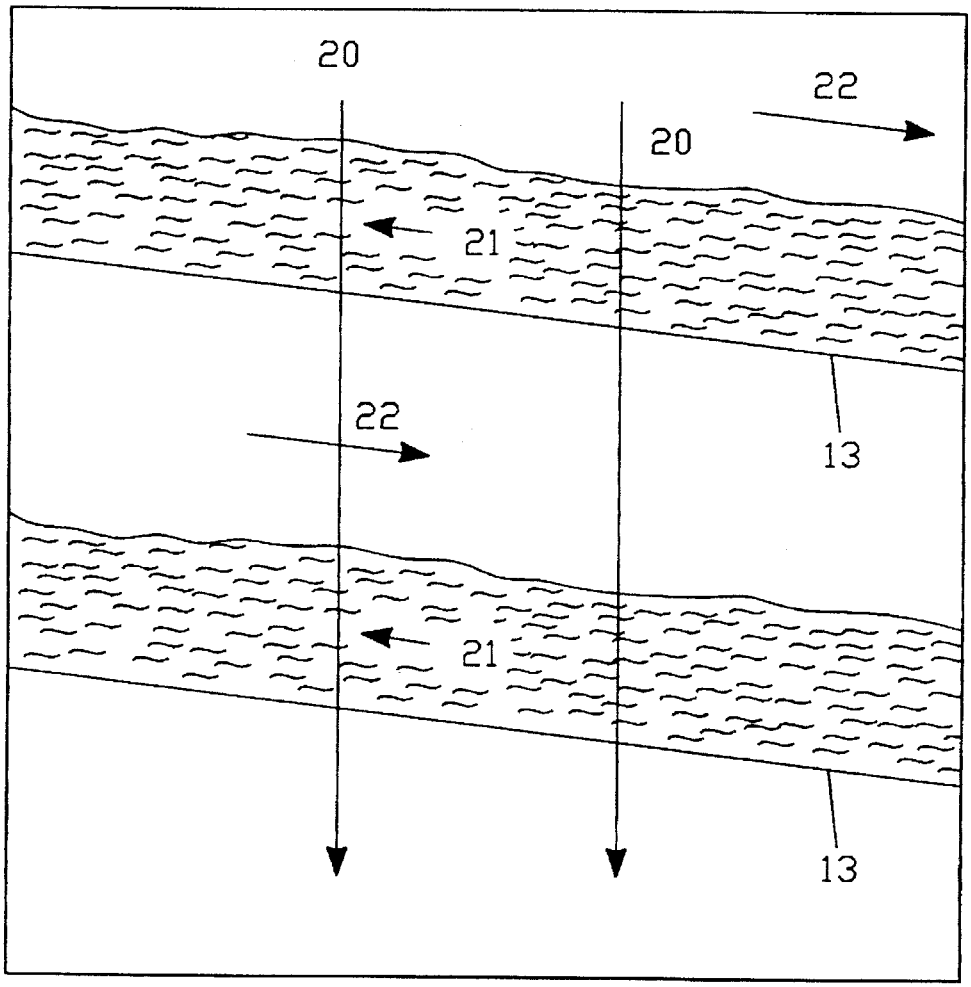
FIG. 3*a* is a cross-sectional view of a portion of the spiral conveyor stack shown in FIG. 3, which shows the path of the air flow relative to the path of the hygroscopic organic material.

The present invention may be carried out as a continuous process most effectively in a Frigoscandia self-stacking spiral conveying machine, such as the one shown in FIG. 3. This apparatus is a specially modified Model GCP 42 spiral freezer supplied by Frigoscandia Food Process Systems AB of Helsingborg, Sweden. Dry tobacco or other suitable hygroscopic organic material to be reordered enters the unit 10 on a conveyor 13, is conveyed through the unit 10 in a spiral geometry from the bottom to the top of the spiral stack 14 as shown, and exits the unit 10 at exit 11 after reordering. Humidified air is blown down through the tobacco or other suitable hygroscopic organic material from the humid air inlet 15 to the bottom of the spiral stack 14 where it exits through the humid air exit 16, essentially flowing countercurrent to the direction of tobacco or other suitable hygroscopic organic material flow, i.e., the majority of the humid-air flow is from the top of the stock downward through the tiers of the tobacco or other suitable hygroscopic organic material bed, while the tobacco or other suitable hygroscopic organic material moves upward following the spiral path of the conveyor. A small portion of the humid air follows the spiral path of the conveyor stack from top to bottom in a true countercurrent path. These types of flow are shown in FIG. 3*a*. When dry tobacco has been reordered, this arrangement has been found to effectively duplicate the ramping of RH obtained in the apparatus of FIG. 2.

Referring to FIG. 3*a*, which is a cross-sectional view of a portion of the spiral conveyor stack 14 shown in FIG. 3, the path of the air flow 20 and 22 relative to the path of the tobacco or other suitable hygroscopic organic material bed 21 is illustrated. As shown in FIG. 3*a*, the air flow 20 and 22 is from the top of the unit downward. The tobacco or other suitable hygroscopic organic material flow is from the bottom to the top of the unit and is illustrated as moving from the right to the left-hand side of FIG. 3*a* as it progresses up the spiral conveyor stack 14. The major portion of the air flow 20, which is essentially countercurrent to the path of the tobacco or other suitable hygroscopic organic material, is directed through the tiers of the tobacco or other suitable hygroscopic organic material bed 21 and contacts the tobacco or other suitable hygroscopic organic material bed 21 on the level immediately below, while a small portion of the air flow 22 passes over the tobacco or other suitable hygroscopic organic material bed 21 in a direction countercurrent to the path of the tobacco or other suitable hygroscopic organic material bed 21. This portion of the air flow 22 may later pass through the tobacco or other suitable hygroscopic organic material bed 21.

Key to the successful implementation of this invention, in the case of reordering, is providing a means of steadily increasing the relative humidity of the air in contact with the tobacco or other suitable hygroscopic organic material as the OV of the tobacco or other hygroscopic organic material increases. The Frigoscandia self-stacking spiral conveyor, by virtue of its self-stacking design, channels the majority of air flow downward through the multiple tiers of conveyor (the conveyor stack), which are carrying tobacco or other suitable hygroscopic organic material. By feeding hygroscopic organic material into the bottom of the conveyor stack and humidified air into the top of the stack, the overall flow of air and hygroscopic organic material is essentially countercurrent. This essentially countercurrent flow provides a natural continuous RH gradient in the air contacting the hygroscopic organic material because the air is progressively dehydrated as it moves downward through the tiers of hygroscopic organic material undergoing the reordering process. By judicious selection of conveyor belt speed, air and hygroscopic organic material flow rates, and control of entering air temperature and RH, conditions like those used in batch laboratory ramped reordering experiments can be approximated on a continuous basis. For the case of reordering approximately 150 lb/hr of 3% OV expanded tobacco, belt speeds which provide from about 40 minutes to about 80 minutes residence time and air conditions of from about 75° F. to about 95° F. with entrance relative humidities of from about 61% to about 64% at air flows of from about 1000 cubic feet per minute (CFM) to about 2500 CFM have been found to provide full reordering without significant CV loss or measurable breakage of the tobacco using the modified Frigoscandia GCP 42 spiral unit.

Devices for recording relative humidity over time such as Model 29-03 RH/Temperature recorder (manufactured by Rustrak Instruments Co. of E. Greenwich, R.I.), have been run through the Frigoscandia unit while reordering tobacco. These devices have shown a steady increase in air relative humidity as the device is conveyed up the spiral stack, with initial RH recordings of from about 35% to about 45% at the bottom of the stack, where tobacco is driest, to about 62% at the top of the stack, where the tobacco is most fully reordered.

Figure 6:
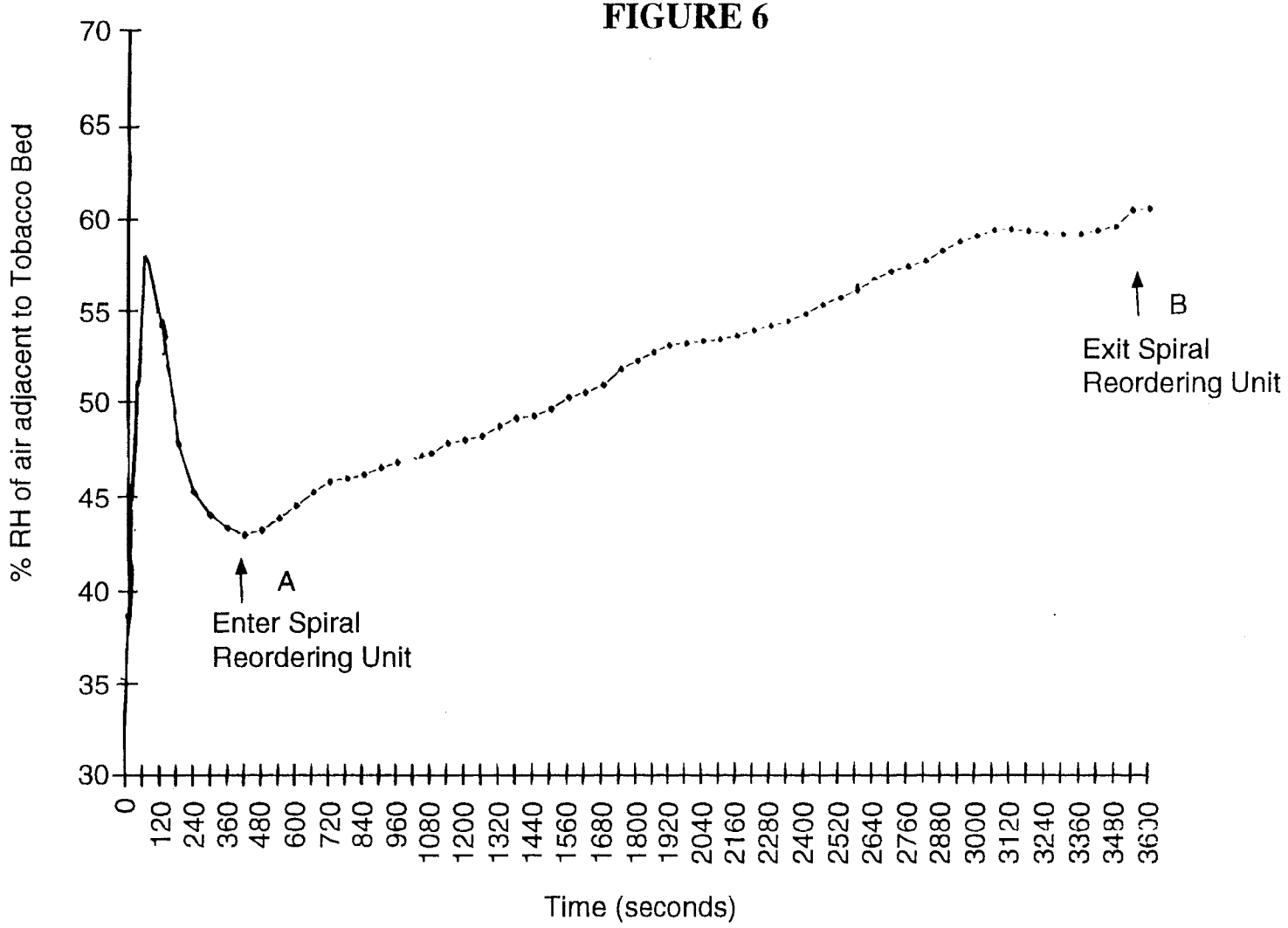
FIG. 6 represents a typical RH profile of the air adjacent to the tobacco over time, obtained during reordering in the apparatus of FIG. 3.

FIG. 6 is a typical curve of RH versus time obtained with the Rustrak unit. The percent RH of the air adjacent to the tobacco bed versus time is shown in FIG. 6. Tobacco with an initial OV of about 3% entered the spiral reordering unit and was contacted with air having an RH of about 43% (Point A of FIG. 6). FIG. 6 shows that as the tobacco progressed through the spiral reordering unit the RH of the air adjacent to the tobacco increased from about 43% to about 62% at the exit of the unit (Point B of FIG. 6). The tobacco had an OV of about 11% upon exiting the spiral reordering unit. The RH of the air entering the spiral reordering unit was controlled to yield reordered tobacco with no significant loss of CV.

Figure 4:
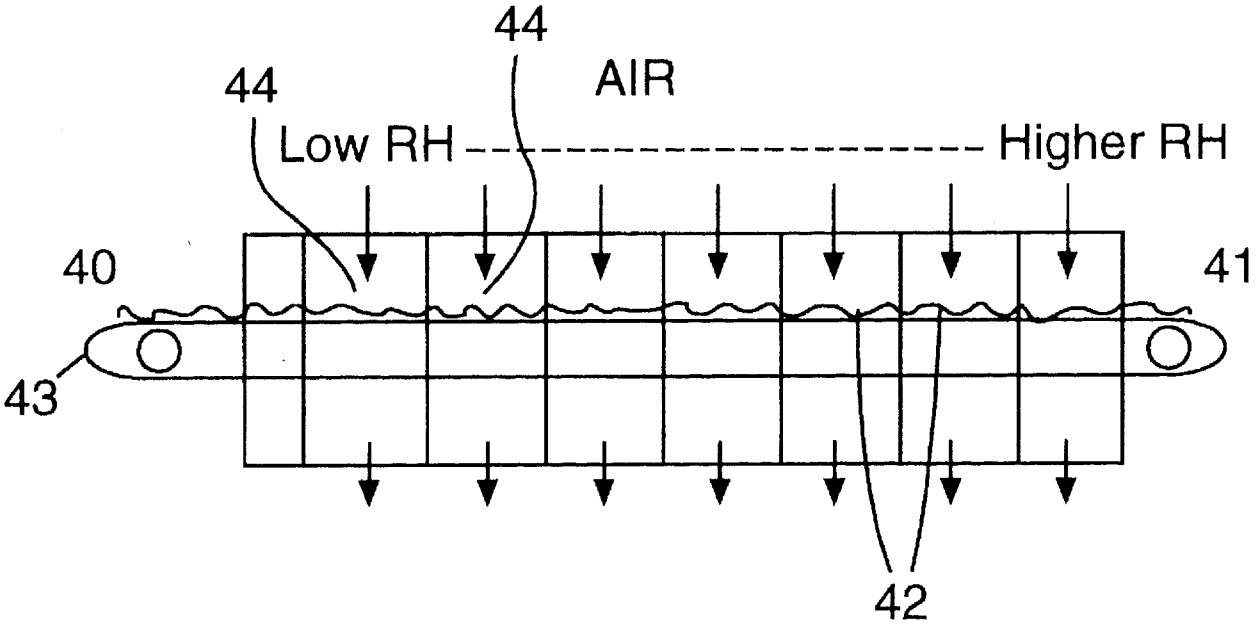
FIG. 4 is a schematic diagram of an alternate apparatus suitable for carrying out this invention on a continuous basis.
Figure 5:
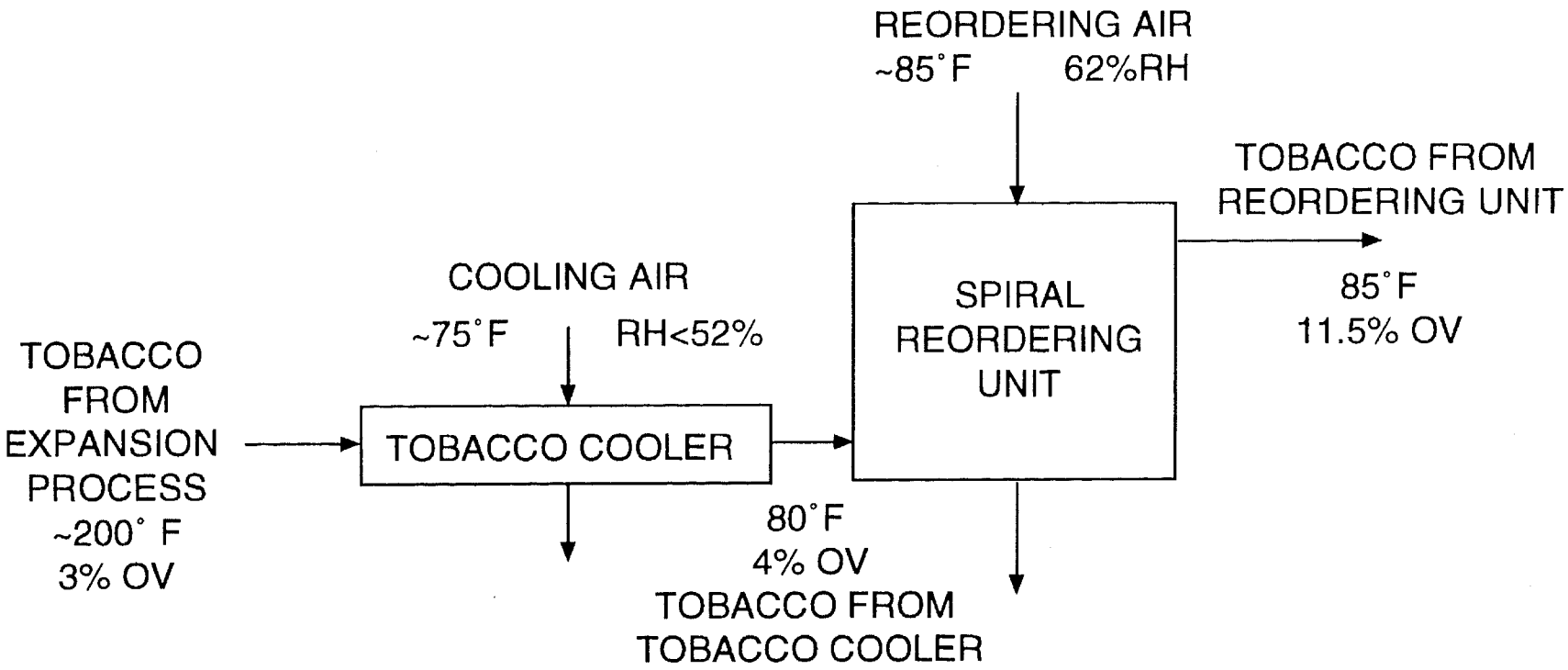
FIG. 5 is a block diagram illustrating the application of the present invention to a reordering process.

Other means of providing ramped RH air, such as the unit shown in FIG. 4, may also be used to carry out this invention on a continuous basis. Referring to FIG. 4, tobacco or other suitable hygroscopic organic material enters the unit at the inlet 40 on conveyor 43, and exits at the exit 41. Air with steadily increasing relative humidity is blown, either up flow or down flow, through the hygroscopic organic material bed 42 in a multiplicity of zones 44 to reproduce the effect of ramping in the apparatus of FIG. 2. This ramping effect could be accomplished by moving air from a single source in a serpentine fashion from the right to left in FIG. 4, providing essentially countercurrent air flow to the direction of tobacco movement. Thus, air exiting a given zone would become the inlet air to the adjacent zone on the left.

To carry out the process of the present invention, one may treat whole cured tobacco leaf, tobacco in cut or chopped form, either expanded or non-expanded tobacco or selected parts of tobacco such as stems or reconstituted tobacco or other suitable hygroscopic organic materials, such as pharmaceutical and agricultural products, including but not limited to fruits, vegetables, cereals, coffee, and tea. The process may be applied to any or all of the above with or without flavorings added. For the specific case of drying tobacco, it has been found that non-expanded cut filler can be dried continuously, at essentially ambient temperature, by essentially countercurrent flow through the modified Frigoscandia self-stacking spiral conveyor from a tobacco moisture content of about 21% OV to about 15% OV in about one hour. In this case, air entered the top of the unit at about 85° F. and about 58% RH and exited at about 77° F. and about 68% RH. Drying was accomplished with little or no thermal treatment of the tobacco.

Alternatively, the process of the present invention may be used to dry tobacco or other suitable hygroscopic organic material having a temperature significantly above ambient temperature, e.g., about 200° F. to about 250° F. When tobacco or other suitable hygroscopic organic material in this temperature range is dried, the RH and temperature of the drying air is adjusted to provide appropriate conditions for carrying out the process of the present invention.

Analogous to reordering tobacco, it was found that drying was best accomplished in a minimum amount of time by setting the final air moisture content lower than that which would be required to bring the tobacco to its desired final moisture level, thereby increasing the air-tobacco moisture gradient, and accordingly, the driving force to bring about the drying. Unlike the reordering process the final moisture content of the air stream can be maintained at a level much less than that which would be in equilibrium with the tobacco at the desired OV level after drying.

EXPERIMENT NO. 1

To demonstrate the advantage of reordering dry, expanded tobacco by metering water to it slowly as compared to spray cylinder reordering, a 20-gram sample of tobacco filler was placed in a sealed desiccator. This sample had been impregnated with liquid carbon dioxide and expanded in an expansion tower at 550° F. The OV of this expanded tobacco filler was 3.4%. It was calculated that approximately 1.89 grams of water would be required to increase this sample's OV content to 11.5%. This amount of water was put into a small glass bottle with a rubber stopper having a ⅛-inch inside diameter glass tube extending through it. The bottle was also sealed in the desiccator. After nine days, all of the water had been adsorbed by the tobacco. The tobacco was then analyzed and found to have an as-is OV of about 11.5%. As used herein, as-is refers to tobacco prior to being equilibrated in an environmental chamber with air maintained at 60% RH and 75° F. passing through it at a low velocity for a period of from 24 hours to 48 hours. This process of equilibration is generally used as a means for bringing tobacco to a standard condition prior to CV, SV and sieve measurements being made. After this standard equilibration, the desiccator-reordered tobacco had a CV of about 9.5 cc/gram and an SV of about 2.9 cc/gram at an OV of about 11.6%. By comparison, when a second sample of the same tobacco was placed directly inside the equilibration chamber and reordered by equilibration under standard conditions, the equilibrated OV was about 11.3% and the CV and SV values were about 9.4 cc/gram and about 2.7 cc/gram, respectively. A third sample of the expanded tobacco filler was reordered in a spray cylinder to an as-is OV of about 11.5%. After equilibration, this sample had a CV of about 8.5 cc/gram and an SV of about 1.9 cc/gram at an equilibrium OV of about 11.6%.

As seen from the data in TABLE 1, the tobacco sample that was reordered in the desiccator by a slow metering of water showed a significant improvement in equilibrium CV and SV compared to the sample that had been spray reordered. This sample also showed a slight improvement in CV and SV when compared with the sample equilibrated directly in the equilibration chamber.

TABLE 1

| | As Is | | Equilibrated | | |
|---|---|---|---|---|---|
| Sample | OV (%) | SV (cc/gm) | OV (%) | CV (cc/gm) | SV (cc/gm) |
| Tower Exit | 3.4 | 3.0 | 11.3 | 9.4 | 2.7 |
| Cylinder Reordered | 11.5 | 1.8 | 11.6 | 8.5 | 1.9 |
| Desiccator | 11.5 | 2.7 | 11.6 | 9.5 | 2.9 |

A second set of experiments was carried out using an environmental chamber to reorder expanded tobacco filler. For this purpose, a Parameter Generation and Control (PGC) chamber was used. This chamber was equipped with a Micro-Pro 2000 microprocessor supplied by Parameter Generation and Control Inc., which permitted controlled ramping of the conditions inside the chamber.

EXPERIMENT NO. 2

Approximately 3 pounds of bright tobacco impregnated with liquid carbon dioxide and expanded under conditions similar to those described in Experiment No. 1, was placed at a bed depth of about 2-inches inside a tray. The tray, which had solid sides and a screen mesh bottom, was placed inside an environmental chamber. The sample was then reordered over a 1-hour period using air at about 75° F. with an initial RH of about 36% ramped to a final RH of about 60%. Air movement was in a downward direction through the tobacco bed at a velocity of about 45 ft/min. This experiment was then repeated over time intervals of 3 hours, 6 hours, and 12 hours. The results, presented in TABLE 2, indicate that for ramping periods up to about 6 hours the rate of reordering does affect tobacco CV and SV, at these experimental conditions. The slower the rate of reordering, the higher the CV and SV observed. Moreover, reordering according to the present invention results in CVs at least about 1 cc/gram greater, and SVs at least about 0.2 cc/gram greater than those observed for tobacco reordered in a spray cylinder. However, it has been found that most of this benefit is achieved by ramping in as little as one hour.

TABLE 2

| | As Is | | Equilibrated In An Environmental Chamber | |
|---|---|---|---|---|
| | OV (%) | SV (cc/gm) | OV (%) | CV (cc/gm) |
| Tower Exit | 3.10 | 3.06 | 11.33 | 9.71 |
| Spray Cylinder | 11.51 | 1.61 | 11.37 | 8.61 |
| Ramped 1 hr. | 10.83 | 1.85 | 11.38 | 9.72 |
| Ramped 3 hr. | 11.44 | 1.88 | 11.36 | 9.81 |
| Ramped 6 hr. | 11.45 | 1.90 | 11.30 | 9.88 |
| Ramped 12 hr. | 11.41 | 1.97 | 11.27 | 9.89 |

EXPERIMENT NO. 3

A laboratory study was conducted on the affect of both reordering rate and temperature on tobacco CV and SV. Seven sets of runs were carried out using tobacco impregnated with carbon dioxide and expanded in an expansion tower at about 550° F. The expanded tobacco was reordered by the following methods:

(1) By equilibrating for 24 hours in an environmental chamber at 60% RH and 75° F. with air movement through the tobacco at a rate of about 25 ft/min;

(2) By spraying with water to increase the OV to about 7.5%, then equilibrating at 60% RH and 75° F. for 24 hours as in (1);

(3) By spraying with water to increase the OV to about 7.5%, then final reordering in a spray cylinder;

(4) By spraying with water to about 7.5% OV, then using humid-air ramped from an initial RH of about 46% to a final RH of about 60%; and (5) By ramping with humid air from about 46% RH to about 60% RH.

Reordering with humid air was carried out inside a PGC environmental chamber equipped with a microprocessor to control ramping over selected time intervals. The following conditions were selected:

(1) Ramping times: 30, 60, and 90 minutes;

(2) Air temperatures: 75° F. and 95° F.;

(3) Air Velocities: upward through the tobacco bed at about 45 ft/min, and downward through the tobacco bed at about 175 ft/min; and (4) Tobacco bed thickness: 2 inches.

The tobacco used for all reordering except through the spray cylinder, was collected at the tower exit after expansion and sealed in double plastic bags prior to reordering. As a result, the tobacco cooled from about 200° F., the temperature of the tobacco at the expansion tower exit, to ambient temperature before reordering. When reordering by ramping at about 95° F., the tobacco, while still in the sealed bags, was prewarmed sufficiently to avoid condensation upon contact with the humid air before being exposed to the ramped conditions. Data for these runs is presented in TABLES 3a through 3e.

TABLE 3a

| | As Is | | Equilibrated | |
|---|---|---|---|---|
| Sample | OV (%) | SV (cc/gm) | OV (%) | CV (cc/gm) |
| X Exit Tower | 3.43 | 3.02 | 11.31 | 9.04 |
| S Through Sprayers Only | 8.06 | 2.14 | 11.68 | 8.66 |
| C Through Sprayers & Cylinder | 11.53 | 1.81 | 11.59 | 8.59 |
| F Through Sprayers & Ramped 90 min (46% RH to 60% RH, 75° F.) | 11.27 | 1.87 | 11.51 | 9.01 |
| H Through Sprayers & Ramped 90 min (46% RH to 60% RH, 75° F.) | 10.96 | 1.98 | 11.36 | 9.48 |
| I Sample H Held 15 min at 60% RH, 75° F. | 11.54 | 1.95 | 11.56 | 9.40 |
| J Through Sprayers & Ramped 60 min (46% RH to 62% RH, 95° F.) | 10.37 | 2.38 | 11.28 | 9.85 |
| K Sample J Held 15 min at 62% RH, 95° F. | 11.17 | 2.26 | 11.22 | 9.88 |

TABLE 3b

| | As Is | | Equilibrated | |
|---|---|---|---|---|
| Sample | OV (%) | SV (cc/gm) | OV (%) | CV (cc/gm) |
| X Exit Tower | 3.01 | 2.58 | 11.34 | 9.23 |
| S Through Sprayers Only | 7.51 | 2.13 | 11.39 | 8.87 |

TABLE 3b-continued

| | As Is | | Equilibrated | |
|---|---|---|---|---|
| Sample | OV (%) | SV (cc/gm) | OV (%) | CV (cc/gm) |
| C Through Sprayers & Cylinder | 11.86 | 1.59 | 11.64 | 8.07 |
| F Through Sprayers & Ramped 60 min (46% RH to 60% RH, 75° F.) | 10.55 | 1.64 | 11.45 | 8.86 |
| G Sample F Held 15 min at 60% RH, 75° F. | 11.56 | 1.64 | 11.42 | 8.61 |
| H Through Sprayers & Ramped 30 Min (46% RH to 60% RH, 75° F.) | 10.28 | 1.97 | 11.27 | 8.99 |
| I Sample H Held 15 min at 60% RH, 75° F. | 11.73 | 1.82 | 11.25 | 8.61 |

TABLE 3c

| | As Is | | Equilibrated | |
|---|---|---|---|---|
| Sample | OV (%) | SV (cc/gm) | OV (%) | CV (cc/gm) |
| A Exit Tower | 1.81 | 2.78 | 11.37 | 9.23 |
| B Ramped 60 min (46% RH to 60% RH, 95° F.) | 10.91 | 1.86 | 11.47 | 8.86 |
| C Ramped 60 min (46% RH to 60% RH, 75° F.) | 10.53 | 2.02 | 11.28 | 9.20 |
| D Ramped 90 min (46% RH to 60% RH, 95° F.) | 10.84 | 1.99 | 11.45 | 8.90 |
| E Through Sprayers | 5.39 | 2.37 | 11.25 | 8.71 |
| F Through Sprayers & Put Directly at 60% RH, 95° F. for 30 min | 10.80 | 1.81 | 11.27 | 8.39 |
| G Through Sprayers & Ramped 60 min (46% RH to 60% RH, 95° F.) | 10.66 | 1.85 | 11.23 | 8.65 |
| H Through Sprayers & Ramped 90 min (46% RH to 60% RH, 95° F.) | 10.76 | 1.82 | 11.24 | 8.62 |
| I Through Sprayers & Ramped 60 min (46% RH to 60% RH, 75° F.) | 10.65 | 1.90 | 11.23 | 8.75 |
| J Through Sprayers & Ramped 90 min (46% RH to 60% RH, 75° F.) | 10.57 | 1.87 | 11.38 | 8.74 |
| K Through Sprayers & Put Directly at 60% RH, 75° F. for 30 min | 10.73 | 1.87 | 11.22 | 8.64 |
| L Through Sprayers and Cylinder | 10.98 | 1.60 | 11.39 | 8.28 |

TABLE 3d

| | As Is | | Equilibrated | |
|---|---|---|---|---|
| Sample | OV (%) | SV (cc/gm) | OV (%) | CV (cc/gm) |
| T1 Exit Tower | 2.83 | 3.01 | 11.92 | 9.46 |
| T2 Put Directly at 60% RH, 75° F., 30 min | 11.24 | 2.27 | 11.77 | 9.08 |
| T3 Ramped 90 min (46% RH to 60% RH, 75° F.) | 11.08 | 2.24 | 11.83 | 9.29 |
| T4 Ramped 90 min (30% RH (to 60% RH, 75° F.) | 9.77 | 2.39 | 11.85 | 9.43 |
| S1 Through Sprayers | 4.78 | 2.82 | 11.66 | 8.98 |
| S2 Through Sprayers & Put Directly at 60% RH, 75° F. for 30 min | 11.10 | 2.19 | 11.64 | 8.89 |
| S3 Through Sprayers & Ramped 90 min (46% RH to 60% RH, 75° F.) | 10.54 | 2.25 | 11.27 | 9.05 |
| S4 Through Sprayers & | 10.56 | 2.22 | 11.73 | 9.03 |

TABLE 3d-continued

| Sample | As Is OV (%) | As Is SV (cc/gm) | Equilibrated OV (%) | Equilibrated CV (cc/gm) |
|---|---|---|---|---|
| Ramped 60 min (46% RH to 60% RH, 75° F.) | | | | |
| S5 Through Sprayers & Ramped 30 min (46% RH to 60% RH, 75° F.) | 9.74 | 2.29 | 11.67 | 9.19 |
| C Through Sprayers and Cylinder | 10.48 | 1.95 | 11.81 | 8.80 |

TABLE 3e

| | Ramping Conditions: Start OV (%) | Avg Air Velocity (ft/min) | Time (min) | Temp (°F.) | RH Range (%) | As Is OV (%) | As Is SV (cc/gm) | Equilibrated OV (%) | Equilibrated CV (cc/gm) |
|---|---|---|---|---|---|---|---|---|---|
| FEED TO TOWER | | | | 15.40 | 0.79 | 11.86 | 5.05 | | |
| EXIT TOWER | | | | | | 3.94 | 2.82 | 11.72 | 9.49 |
| EXIT STAGE 1 SPRAY | | | | | | 5.64 | 2.72 | 11.82 | 9.48 |
| EXIT CYLINDER | | | | | | 10.36 | 2.04 | 11.66 | 9.28 |
| A | 3.9 | 235 | 60 | 75 | 30–58 | 6.67 | 2.39 | 11.65 | 9.76 |
| B | 5.6 | 175 | 60 | 75 | 30–58 | 8.44 | 2.45 | 11.82 | 9.91 |
| C | 3.9 | 190 | 60 | 75 | 45–58 | 7.83 | 2.25 | 11.65 | 9.57 |
| D | 5.6 | 190 | 60 | 75 | 45–58 | 8.44 | 2.39 | 11.79 | 9.66 |
| E | 3.9 | 190 | 60 | 75 | 47–62 | 11.10 | 2.33 | 11.74 | 10.02 |
| F | 5.6 | 175 | 60 | 75 | 47–62 | 10.10 | 2.41 | 11.59 | 10.08 |
| G | 3.9 | 180 | 60 | 75 | 30–62 | 8.13 | 2.20 | 11.89 | 9.63 |
| H | 5.6 | 175 | 60 | 75 | 30–62 | 9.41 | 2.41 | 11.79 | 10.11 |
| I | 3.9 | 200 | 60 | 75 | 47–62 | 10.21 | 2.15 | 11.76 | 8.98 |
| J | 3.9 | 180 | 60 | 75 | 47–64 | 10.18 | 2.13 | 11.94 | 9.03 |
| K | 3.9 | 180 | 60 | 75 | 35–64 | 9.07 | 2.23 | 11.90 | 9.51 |
| L | 3.9 | 180 | 60 | 90 | 35–60 | 8.65 | 2.17 | 12.09 | 8.59 |
| M | 3.9 | 180 | 60 | 90 | 45–60 | 10.11 | 2.39 | 11.92 | 10.02 |
| N | 5.6 | 180 | 60 | 90 | 45–60 | 10.08 | 2.39 | 11.93 | 10.02 |
| O | 3.9 | 240 | 60 | 90 | 47–64 | 10.88 | 2.31 | 11.96 | 9.51 |
| P | 3.9 | 240 | 60 | 90 | 47–64 | 11.30 | 2.33 | 11.95 | 9.30 |

The data presented in TABLES 3a through 3e show that gains of from about 0.5 cc/gram to about 1 cc/gram in CV and from about 0.3 cc/gram to about 0.4 cc/gram in SV may be achieved by ramped reordering of cooled tobacco, i.e., tobacco at about 75° F. up to about 95° F., as compared to cylinder spray reordering of hot tobacco exiting the expansion tower. Ramped reordering directly from the tower exit OV was found to be preferable to first spraying the tobacco to increase its OV content to about 7% followed by ramped reordering. No significant difference was seen in the CV or SV of tobacco reordered by ramping using humid air with an initial RH of about 46% as compared to tobacco reordered by ramping from an initial RH of about 30%, or in tobacco reordered by ramping over a period of either about 60 minutes or about 90 minutes. It was also observed that tobacco could be reordered either with the air movement directed downward through the tobacco bed at velocities of from about 175 ft/min to about 235 ft/min or with the air directed upward through the tobacco bed at up to about 45 ft/min with no significant differences in CV or SV. Additionally, it was observed that ramped reordering yielded equivalent or better CVs and SVs as compared to tobacco reordered by placing it directly in an environmental chamber at 60% RH and 75° F. after exiting the expansion tower. Finally, it was observed that spraying with water to increase the OV to about 7.5% followed by ramping with humid air resulted in better CVs and SVs as compared to spraying followed by final reordering in a spray cylinder.

EXPERIMENT NO. 4

Tests were conducted to determine the effect of air flow and air velocity on entrainment, channeling, and compaction of the tobacco. These tests were carried out using two PGC environmental chambers. In both chambers, actual air movement was approximately 500 CFM. Air movement was in an upward direction through the tobacco bed in one PGC chamber, and in a downward direction through the tobacco bed in the other. Tobacco samples, 2-inches in depth, were placed inside open-top trays 5"×5¾" with screen mesh bottoms and with 4-inch high solid sides. These trays were placed on shelves inside the environmental chambers. Air was forced through the samples by covering the non-occupied shelf area with cardboard and sealing any cracks with tape. Air velocity was varied by changing the number of sample containers through which the air passed. Tobacco used for these tests was impregnated with carbon dioxide and expanded at about 550° F. The tobacco had been reordered through a first stage by spraying with water to about 8% OV immediately after expansion. Conditions inside the chambers during the tests were controlled at about 75° F. and about 60% RH. Both a vane anemometer (Airflow Instrumentation, Model LCA 6000, Frederick, Md.) and a hot-wire anemometer (Alnor Instrument Company Skokie, Ill., Thermometer Model 8525) were used to measure air velocities. These instruments were placed directly above or below the samples for air movement in the upward and downward directions, respectively.

With air movement in an upward direction, some slight lifting of the tobacco was observed immediately when the air was turned on at average velocities as low about 26 ft/min. Small air channels then formed, and the tobacco would settle. As a result of these channels, air flow was found to be very nonuniform across the tobacco bed (about 22 ft/min to above 45 ft/min for an average flow of about 26 ft/min). With increasing average air flows, more channeling was apparent, and at above 45 ft/min considerable entrainment and "blow up" of tobacco was observed, followed by significant channeling of the bed.

With air movement in a downward direction some compaction and corresponding reduction in air velocity through the beds was observed at all velocities studied. This is shown in TABLE 4. At an initial velocity of about 192 ft/min, tobacco bed depth compacted about 28%, and, as a result, the air velocity through the bed was reduced to about 141 ft/min. At initial air velocities of about 141 ft/min or less, tobacco bed compaction was about half that observed at about 192 ft/min, and air flow through the tobacco bed was reduced much less.

TABLE 4

Effect of Bed Compaction on Air Velocity Through Bed

| Air Velocity (ft/min) | | | Bed Depth (in) | | |
|---|---|---|---|---|---|
| Start | End | % Change | Start | End | % Change |
| 192 | 141 | 27 | 2 | 1.45 | 28 |
| 161 | 144 | 11 | 2 | 1.65 | 18 |
| 141 | 133 | 6 | 2 | 1.70 | 15 |
| 104 | 98 | 6 | 2 | 1.80 | 10 |
| 43 | 41 | 5 | 2 | 1.90 | 5 |

Based on the above experiments it was determined that expanded tobacco can be reordered preferably by ramping at the following conditions:

(a) Time: from about 60 minutes to about 90 minutes;

(b) RH: from an initial RH of from about 30% to about 45% to a final RH of from about 60% to about 64%;

(c) Temperature: from about 75° F. to about 95° F.;

(d) Air flow: upward at velocities up to about 45 ft/min or downward at velocities up to about 235 ft/min.

EXPERIMENT NO. 5

Approximately 150 lb/hr of a mixture of bright and burley tobacco, which had been impregnated with carbon dioxide according to the process described in co-pending and commonly assigned application Cho et al., Ser. No. 07/717,067, and expanded as described in the above examples, was passed through a cooling conveyor to reduce its temperature from about 200° F. to about 85° F. prior to being fed to a modified Frigoscandia Model GCP 42 self-stacking spiral unit. Tobacco flow through the spiral unit was from the bottom to the top. Air flow was from the top to the bottom of the unit, providing an essentially countercurrent flow of tobacco to air. This arrangement provided ramped reordering of the tobacco as a result of the continuous dehydration of the air by the reordering tobacco. Tobacco entered the process at about 3% OV and exited at about 11% OV. Equilibrated CV of the feed material was about 10.53 cc/gm, while the equilibrated CV of the reordered material was about 10.46 cc/gm, indicating no significant loss of filling power of the tobacco across the reordering process, i.e., no statistically significant loss of filing power as determined by standard analysis of variance procedure. Additionally, there was no measurable reduction in tobacco particle size, as determined by the sieve test, during the reordering process.

EXPERIMENT NO. 6

A series of experiments was carried out using various types of tobacco expanded at different tower temperatures in which the tobacco was reordered according to the process of the present invention. In each run, approximately 150 lb/hr of tobacco, based on reordered tobacco mass, was reordered in the modified Frigoscandia self-stacking spiral unit described in Experiment No. 5. The inlet air to the reordering unit was set at about 85° F. with a relative humidity of about 62%. The air exiting the reordering unit was typically about 90° F. to about 95° F. with a relative humidity of about 40% to about 45%. As shown in TABLE 5, tobacco reordered according to the process of the present invention showed no significant loss of filling power.

TABLE 5

| | | | | | | Equilibrated | | |
|---|---|---|---|---|---|---|---|---|
| Tobacco Type | Run No. | Tower Temp. (°F.) | OV in (%) | OV out (%) | CV in (cc/gm) | OV in (%) | CV out (cc/gm) | OV out (%) |
| Bright | FO 205C | 550 | 2.70 | 11.16 | 9.93 | 11.87 | 9.40 | 12.00 |
| | FO 205A | 610 | 2.11 | 11.58 | 10.41 | 11.57 | 10.83 | 11.56 |
| | FO 205B | 625 | 1.87 | 9.99 | 11.30 | 11.30 | 10.90 | 11.50 |
| Bright | FO 206A | 580 | 2.47 | 11.09 | 10.00 | 12.34 | 10.20 | 11.74 |
| | FO 217 | 610 | 2.59 | 10.86 | 10.49 | 11.79 | 10.51 | 11.63 |
| Burley | FO 206B | 480 | 3.11 | 10.75 | 12.39 | 10.91 | 12.31 | 10.52 |
| | FO 206C | 520 | 2.95 | 10.22 | 12.08 | 10.85 | 12.41 | 10.40 |
| | FO 214 | 520 | 3.00 | 10.4 | 11.3 | 10.4 | 11.2 | 10.4 |

EXPERIMENT NO. 7

Approximately 200 lb/hr. of bright tobacco with an OV of about 21.6% was fed to the modified Frigoscandia self-stacking unit described in Experiment No. 5 operating as a drying unit. Tobacco flow through the spiral drying unit was from the bottom to the top. Air flow was from the top to the bottom of the unit, providing an essentially countercurrent flow of tobacco to air. The tobacco was successfully dried to about 12.2% OV in about 60 minutes residence time using air with an inlet temperature of about 95° F. and an inlet RH of about 35%. Air exiting the drying unit was at about 83° F. and about 62% RH. The tobacco entering and exiting the drying unit was cool to the touch, with an estimated temperature of about 75° F., indicating that substantially no thermal treatment of the tobacco had taken place. No change in the equilibrated tobacco CV occurred as a result of the drying process. This particular drying experiment was designed to minimize thermal treatment. Similar drying results could be achieved using higher temperatures to provide a controlled degree of thermal treatment.

While the invention has been particularly shown and described with reference to preferred embodiments, it will be understood by those skilled in the art that various changes in form and details may be made without departing from the spirit and scope of the invention.

We claim:

1. A process for increasing the moisture content of organic material which comprises the steps of:

(a) contacting organic material with an air stream having a relative humidity near the equilibrium conditions of the organic material, and (b) increasing the relative humidity of the air stream contacting the organic material to increase the moisture content of the organic material in such a manner that the relative humidity of the air stream contacting the organic material is maintained near the equilibrium conditions of the organic material until the desired moisture content of the organic material is achieved.

2. The process of claim 1, wherein the organic material is organic.

3. The process of claim 2, wherein the organic material is selected from the group consisting of fruits, vegetables, cereals, coffee, pharmaceuticals, tea, and any combination of these.

4. The process of claim 2, wherein the equilibrated CV of the organic material after step (b) is not significantly less than the equilibrated CV of the organic material prior to step (a).

5. The process of claim 2, wherein step (a), contacting organic material with an air stream having a relative humidity near the equilibrium conditions of the organic material, is carried out in a continuous manner using a spiral conveyor.

6. The process of claim 2, wherein step (a), contacting organic material with an air stream having a relative humidity near the equilibrium conditions of the organic material, is carried out in a continuous manner using a linear conveyor.

7. The process of claim 2, wherein the organic material temperature is below about 100° F. prior to contacting it with the air stream of step (a).

8. The process of claim 2, wherein prior to step (a), contacting organic material with an air stream having a relative humidity near the equilibrium conditions of the organic material, the organic material has an initial moisture content of from about 1.5% to about 13%.

9. The process of claim 8, wherein prior to step (a), contacting organic material with an air stream having a relative humidity near the equilibrium conditions of the organic material, the organic material has an initial moisture content of from about 1.5% to about 6%.

10. A process for increasing the moisture content of organic material which comprises the steps of:

(a) forming an organic material bed by depositing organic material on a conveyor, (b) contacting the organic material with an air stream flowing in a path essentially countercurrent to the path of the organic material bed, and (c) causing a portion of the moisture content of the air stream to be transferred to the organic material in such a manner that the relative humidity of the air stream contacting the organic material is maintained near the equilibrium conditions of the organic material, whereby the air stream is progressively dehydrated and the organic material is progressively hydrated as the air stream flows essentially countercurrent to the path of the organic material bed until the desired moisture content of the organic material is achieved.

11. The process of claim 10, wherein the organic material is organic.

12. The process of claim 11, wherein the organic material is selected from the group consisting of fruits, vegetables, cereals, coffee, pharmaceuticals, tea, and any combination of these.

13. The process of claim 11, wherein the equilibrated CV of the organic material after step (c) is not significantly less than the equilibrated CV of the organic material prior to step (b).

14. The process of claim 11, wherein step (b), contacting the organic material with an air stream flowing in a path essentially countercurrent to the path of the organic material bed, is carried out in a continuous manner using a spiral conveyor.

15. The process of claim 11, wherein step (b), contacting the organic material with an air stream flowing in a path essentially countercurrent to the path of the organic material bed, is carried out in a continuous manner using a linear conveyor, which is configured to provide a multiplicity of zones of increasing relative humidity.

16. The process of claim 11, wherein the organic material temperature is below about 100° F. prior to contacting it with the air stream of step (b).

17. The process of claim 11, wherein prior to step (b), contacting the organic material with an air stream flowing in a path essentially countercurrent to the path of the organic material bed, the organic material has an initial moisture content of about 1.5% to about 13%.

18. The process of claim 17, wherein prior to step (b), contacting the organic material with an air stream flowing in a path essentially countercurrent to the path of the organic material bed, the organic material has an initial moisture content of from about 1.5% to about 6%.

19. The process of claim 11, wherein the desired moisture content of the organic material after step (c) is from about 11% to about 13%.

20. The process of claim 11, wherein the air stream contacting the organic material has a relative humidity of from about 30% to about 64% at a temperature of from about 70° F. to about 120° F.

21. The process of claim 11, wherein step (b), contacting the organic material with an air stream flowing in a path essentially countercurrent to the path of the organic material bed, is carried out using an air stream having a velocity of from about 45 feet/minute to about 240 feet/minute.

22. The process of claim 11, wherein step (b), contacting the organic material with an air stream flowing in a path essentially countercurrent to the path of the organic material bed, is carried out by directing the air stream either downward or upward through the organic material bed, or by directing the air stream both downward and upward through the organic material bed.

23. The process of claim 11, wherein the temperature of the air stream is selected to provide a desired thermal treatment to the organic material, while the relative humidity of the air stream is selected to provide reordering.

24. The process of claim 23, wherein the temperature of the air stream is from about 75° F. to about 180° F.

25. A process for decreasing the moisture content of organic material which comprises the steps of:

(a) contacting organic material with an air stream having a relative humidity near or below the equilibrium conditions of the organic material, and (b) decreasing the relative humidity of the air stream contacting the organic material as the moisture content of the organic material decreases in such a manner that the relative humidity of the air stream contacting the organic material is maintained near or below the equilibrium conditions of the organic material until the desired moisture content of the organic material is achieved.

26. The process of claim 25, wherein the organic material is a hygroscopic organic material.

27. A process for decreasing the moisture content of organic material which comprises the steps of:

(a) contacting organic material with an air stream having a relative humidity near or below the equilibrium conditions of the organic material, and (b) decreasing the relative humidity of the air stream contacting the organic material as the moisture content of the organic material decreases in such a manner that the relative humidity of the air stream contacting the organic material is maintained near or below the equilibrium conditions of the organic material until the desired moisture content of the organic material is achieved, wherein the organic material is a hygroscopic organic material and the hygroscopic organic material is selected from the group consisting of fruits, vegetables, cereals, coffee, pharmaceuticals, tea, and any combination of these.

28. The process of claim 27, wherein the equilibrated CV of the organic material after step (b) is not significantly lower than the equilibrated CV of the organic material prior to step (a).

29. The process of claim 26, wherein said contacting step (a) is performed in a continuous manner using a spiral conveyor, said contacting step (a) including the steps of moving the organic material continuously through said spiral conveyor while continuously directing said air stream through said spiral conveyor in a countercurrent relation to said moving organic material.

30. The process of claim 26, wherein said contacting step (a) is performed in a continuous manner using a linear conveyor which is configured to provide a multiplicity of zones of decreasing relative humidity.

31. A process for decreasing the moisture content of organic material which comprises the steps of:

(a) contacting organic material with an air stream having a relative humidity near or below the equilibrium conditions of the organic material, and (b) decreasing the relative humidity of the air stream contacting the organic material as the moisture content of the organic material decreases in such a manner that the relative humidity of the air stream contacting the organic material is maintained near or below the equilibrium conditions of the organic material until the desired moisture content of the organic material is achieved, wherein the organic material is a hygroscopic organic material and the organic material temperature is below about 250° F. prior to contacting it with the air stream of step (a).

32. The process of claim 31, further comprising the step of preheating the organic material to a temperature of from about 100° F. to about 250° F. prior to step (a).

33. The process of claim 32, wherein the organic material temperature is below about 100° F. prior to contacting it with the air stream of step (a).

34. A process for decreasing the moisture content of organic material which comprises the steps of:

(a) conveying an organic material bed along a path, (b) contacting the organic material with an air stream flowing in a path essentially countercurrent to the path of the organic material bed, and (c) causing a portion of the moisture content of the organic material to be transferred to the air stream in such a manner that the relative humidity of the air stream contacting the organic material is maintained near or below the equilibrium conditions of the organic material, whereby the organic material is progressively dehydrated and the air stream is progressively hydrated as the air stream travels in said path essentially countercurrent to the path of the organic material bed until the desired moisture content of the organic materials is achieved.

35. The process of claim 34, wherein the organic material is a hygroscopic organic material.

36. A process for decreasing the moisture content of organic material which comprises the steps of:

(a) forming an organic material bed by depositing organic material on a conveyor.

(b) contacting the organic material with an air stream flowing in a path essentially countercurrent to the path of the organic material bed, and (c) causing a portion of the moisture content of the organic material to be transferred to the air stream in such a manner that the relative humidity of the air stream contacting the organic material is maintained near or below the equilibrium conditions of the organic material, whereby the organic material is progressively dehydrated and the air stream is progressively hydrated as the air stream travels in a path essentially countercurrent to the path of the organic material bed until the desired moisture content or the organic materials is achieved, wherein the organic material is a hygroscopic organic material and the hygroscopic organic material is selected from the group consisting of fruits, vegetables, cereals, coffee, pharmaceuticals, tea, and any combination of these.

37. The process of claim 36, wherein the equilibrated CV of the organic material after step (c) is not significantly lower than the equilibrated CV of the organic material prior to step (b).

38. A process for decreasing the moisture content of organic material which comprises the steps of:

(a) forming an organic material bed by depositing organic material on a conveyor, (b) contacting the organic material with an air stream flowing in a path essentially countercurrent to the path of the organic material bed, and (c) causing a portion of the moisture content of the organic material to be transferred to the air stream in such a manner that the relative humidity of the air stream contacting the organic material is maintained near or below the equilibrium conditions of the organic material, whereby the organic material is progressively dehydrated and the air stream is progressively hydrated as the air stream travels in a path essentially countercurrent to the path of the organic material bed until the desired moisture content or the organic materials is achieved, wherein the organic material is hygroscopic organic material and said step (b), contacting the organic material with an air stream flowing in a path essentially countercurrent to the path of the organic material bed, is carried out in a continuous manner using a spiral conveyor.

39. The process of claim 36, wherein step (b), contacting the organic material with an air stream flowing in a path essentially countercurrent to the path of the organic material bed, is carried out in a continuous manner using a linear conveyor, which is configured to provide a multiplicity of zones of decreasing relative humidity.

40. The process of claim 36, wherein the organic material temperature is below about 250° F. prior to contacting it with the air stream of step (b).

41. The process of claim 40, wherein the organic material temperature is below about 100° F. prior to contacting it with the air stream of step (b).

42. The process of claim 36, wherein prior to step (b), contacting the organic material with an air stream flowing in a path essentially countercurrent to the path of the organic material bed, the organic material has a moisture content of from about 11% to about 40%.

43. The process of claim 36, wherein the air stream of step (b) has a relative humidity of from about 20% to about 60% at a temperature of from about 70° F. to about 120° F.

44. The process of claim 36, wherein step (b), contacting the organic material with an air stream flowing in a path essentially countercurrent to the path of the organic material bed, is carried out using an air stream having a velocity of from about 45 feet/minute to about 240 feet/minute.

45. The process of claim 36, wherein step (b), contacting the organic material with an air stream flowing in a path essentially countercurrent to the path of the organic material bed, is carried out by directing the air stream either downward or upward through the organic material bed, or by directing the air stream both downward and upward through the organic material bed.

46. The process of claim 36, wherein the temperature of the air stream is selected to provide a desired thermal treatment.

47. The process of claim 36, wherein the temperature of the air stream is selected to provide substantially no thermal treatment.

48. The process of claim 36, wherein the temperature of the air stream is from about 75° F. to about 250° F.

49. The process of claim 38, wherein said contacting step includes directing said air stream through tiers of said spiral conveyor in succession.

50. The process of claim 49, wherein said air stream is directed vertically downward through said tiers.

51. The process of claim 14, wherein said spiral conveyor includes tiers, said air stream flowing through said tiers in succession.

52. The process of claim 51, wherein said air stream is directed vertically downward through said tiers.

53. The process of claim 25 wherein said maintaining near or below the equilibrium conditions includes controlling temperature and relative humidity of the air stream as it enters said countercurrent path.

* * * * *